US008950335B2

(12) United States Patent
Strömberg et al.

(10) Patent No.: US 8,950,335 B2
(45) Date of Patent: Feb. 10, 2015

(54) PERMANENT SLIPPING ROTATING BAND AND METHOD FOR PRODUCING SUCH A BAND

(75) Inventors: Sven Strömberg, Karlskoga (SE); Lars-Åke Carlqvist, Karlskoga (SE); Johan Lidgren, Karlskoga (SE); Andreas Nilsson, Karlskoga (SE); Lars-Peter Svanberg, Stockholm (SE)

(73) Assignee: BAE Systems Bofors AB, Karlskoga (SE)

( * ) Notice: Subject to any disclaimer, the term of this patent is extended or adjusted under 35 U.S.C. 154(b) by 0 days.

(21) Appl. No.: 14/111,414

(22) PCT Filed: Apr. 12, 2012

(86) PCT No.: PCT/SE2012/000052

§ 371 (c)(1),
(2), (4) Date: Dec. 9, 2013

(87) PCT Pub. No.: WO2012/141640

PCT Pub. Date: Oct. 18, 2012

(65) Prior Publication Data

US 2014/0083320 A1 Mar. 27, 2014

(30) Foreign Application Priority Data

Apr. 14, 2011 (SE) ..... 1130028

(51) Int. Cl.
*F42B 14/02* (2006.01)

(52) U.S. Cl.
CPC ..... *F42B 14/02* (2013.01)
USPC ..... 102/527; 102/524

(58) Field of Classification Search
USPC ..... 102/524–528
See application file for complete search history.

(56) References Cited

U.S. PATENT DOCUMENTS 2,927,535 A 3/1960 Abramson et al.
3,738,279 A 6/1973 Eyre et al.

(Continued)

FOREIGN PATENT DOCUMENTS

DE 1083708 B 6/1960
DE 2331158 A1 1/1975

(Continued)

OTHER PUBLICATIONS

Supplementary European Search Report issued in EP Appln No. EP12771990 received Sep. 15, 2014.

*Primary Examiner* — Jonathan C Weber
(74) *Attorney, Agent, or Firm* — Novak Druce Connolly Bove + Quigg LLP

(57) ABSTRACT

The invention relates to a projectile (6) provided with a slipping rotating band (1) which is designed for firing from a weapon system with a rifled barrel. The rotating band (1) comprises an inner ring (2) and an outer ring (3) that seals against the barrel. The outer ring is fitted on the outer surface of the inner ring and the inner ring is slippably fitted on the projectile. The rotating band (1) is configured to remain fitted on the projectile (6) from launcher to target by virtue of the fact that the inner ring (2) is made of fibre-reinforced polymer composite or particle-reinforced polymer composite, or fibre-reinforced metal matrix composite or particle-reinforced metal matrix composite. The invention also relates to a slipping rotating band (1) and to a method for producing a slipping rotating band (1) in which the outer ring (3) is affixed to the inner ring (2).

20 Claims, 2 Drawing Sheets

(56) References Cited

U.S. PATENT DOCUMENTS

| | | | | | |
|---|---|---|---|---|---|
| 3,744,426 | A | * | 7/1973 | Butler | 102/527 |
| 3,760,736 | A | | 9/1973 | Eig | |
| 4,242,961 | A | | 1/1981 | Moredock et al. | |
| 4,384,529 | A | * | 5/1983 | Burns et al. | 102/525 |
| 4,532,868 | A | * | 8/1985 | Gleichaut et al. | 102/527 |
| 4,552,071 | A | | 11/1985 | Horais et al. | |
| 4,651,649 | A | * | 3/1987 | Nussbaum | 102/521 |
| 4,754,707 | A | * | 7/1988 | Ahlers | 102/527 |
| 4,907,513 | A | | 3/1990 | Manion et al. | |
| 5,063,854 | A | | 11/1991 | Bisping et al. | |
| 5,682,011 | A | * | 10/1997 | Sabranski et al. | 102/527 |
| 6,453,821 | B1 | | 9/2002 | Fowler et al. | |
| 6,712,005 | B2 | * | 3/2004 | Heitmann | 102/439 |
| 2003/0167957 | A1 | * | 9/2003 | Heitmann | 102/521 |

FOREIGN PATENT DOCUMENTS

| | | | |
|---|---|---|---|
| EP | 0853229 | A1 | 7/1998 |
| GB | 735012 | A | 8/1955 |
| WO | WO-2006/092637 | A2 | 9/2006 |

* cited by examiner

PERMANENT SLIPPING ROTATING BAND AND METHOD FOR PRODUCING SUCH A BAND

CROSS REFERENCE TO RELATED APPLICATIONS

This application is a National Phase filing under 35 U.S.C. §371 of PCT/SE2012/000052 filed on Apr. 12, 2012; and this application claims priority to Application No. 1130028-2 filed in Sweden on Apr. 14, 2011, under 35 U.S.C. §119; the entire contents of all are hereby incorporated by reference.

TECHNICAL FIELD

The present invention relates to a projectile provided with a slipping rotating band designed for firing from a weapon system with rifled barrel. The rotating band comprises an inner concentric ring and an outer concentric ring that seals against the barrel. The outer ring is fitted on the outer surface of the inner ring and the said inner ring is slippably fitted on the projectile. The invention further relates to a slipping rotating band intended to be slippably fitted on a projectile, which rotating band comprises an inner and an outer concentric ring. In addition thereto, the invention further relates to a method for producing a slipping rotating band comprising an inner and an outer concentric ring.

BACKGROUND TO THE INVENTION, PROBLEM DEFINITION AND PRIOR ART

Rotating bands are used on projectiles fired from barrels in order to give both a gas seal between the projectile and the barrel and a good friction coupling against the barrel. Traditionally, projectiles are rotationally stabilized in order to acquire better aerodynamic properties, by virtue of the projectile being made to rotate during the launch process as the result of a rifling made in the barrel. When the projectile provided with a rotating band is driven out of the barrel, the rotating band is partially deformed by the rifling and thus the rotating band grips the rifling and rotates the projectile with the pitch belonging to the rifling. Should a guidable projectile be desired, it is expedient for the projectile to be roll-stable, that is to say non-rotating, when fins are deployed and in use. Since it is desirable to use the same barrel, and thus launcher, for all projectiles, the guidable projectiles are constructed with a slipping rotating band and can thus be launched from a rifled barrel. The slipping rotating band of the guidable projectile will grip the rifling in the barrel and create a gas seal. When the projectile is propelled in the barrel, the rotating band will rotate with the pitch of the rifling. The coupling between the rotating band and the projectile is constructed such that the friction is low and slipping or sliding against the projectile occurs, which means that the projectile does not rotate or rotates with a significantly lesser rotation than in the case of a fixedly mounted rotating band. When the projectile leaves the barrel, the rotation of the projectile will be low. Apart from the fact that it is advantageous for guidable projectiles to be roll-stable, a low rotation in the barrel is important in order to reduce the forces which are generated by the angular acceleration and to which the electronics and mechanics mounted in the projectile are subjected at launch.

U.S. Pat. No. 4,552,071 A, for example, discloses an invention which shows a slipping rotating band consisting of two concentric parts, firstly an outer ring, referred to as a wiper, and secondly an inner ring, in which the part referred to as a wiper is made of a soft material, for example nylon-6. The rotating band is designed, however, not to remain permanently in place after the projectile has left the barrel.

An example of another previously known invention can be found in U.S. Pat. No. 6,453,821 B1, which shows a rotating band for handling high temperatures. The description in the patent text refers to a number of alternative materials, for example in the form of a composite. A projectile is provided with a groove made, in principle, in the middle of the projectile, which is especially suitable for long projectiles. A rotating band is mounted in the groove and configured with notches on the outer radius of the rotating band. The rotating band is not permanent, but will be broken into parts after the projectile has left the barrel. Once the rotating band has been accelerated to the same speed as the projectile, then the rotating band or parts of the rotating band will, per se, become one or more projectiles and give rise to an increased risk for persons and equipment in the surrounds of the launcher.

Permanent and fixedly mounted rotating bands are usually found on rotationally stabilized ammunition and are then often made of a softer metal, for example copper. These rotating bands are not slipping, since a good contact between the rotating band and the projectile is necessary to obtain high rotation of the projectile and thus also good rotational stability of the projectile in the path between the launcher and the target. Permanent and fixedly mounted rotating bands cannot therefore be used for roll-stable guidable projectiles.

OBJECT OF THE INVENTION AND ITS DISTINGUISHING FEATURES

The design of the rotating band by combining a soft outer part and a load-bearing inner part produces an improved rotating band, which, through reinforcement of the load-bearing part, is constructed such that the rotating band remains in place throughout the launch process and along the path of the projectile. The outer part is made of a softer material than the load-bearing inner part in order to allow the projectile to be set up and held in the firing position in the launcher by deformation of the outer ring against the rifling of the barrel, and form a seal between the projectile and the barrel when the projectile is propelled in the barrel.

The invention is constituted by a projectile provided with a slipping rotating band designed for firing from a weapon system with rifled barrel, which rotating band comprises an inner concentric ring and an outer concentric ring that seals against the barrel, which outer ring is fitted on the outer surface of the inner ring and which inner ring is slippably fitted on the projectile, in which the rotating band is configured to remain fitted on the projectile throughout the launch process of the projectile and along the path of the projectile from launcher to target by virtue of the fact that the outer ring, which seals against the barrel, is affixed to the inner ring, and that the inner ring slippably fitted on the projectile is made of fibre-reinforced polymer composite or particle-reinforced polymer composite, or fibre-reinforced metal matrix composite or particle-reinforced metal matrix composite.

According to further aspects of the improved permanent slipping rotating band according to the invention:

the fibre-reinforced polymer composite material of the inner ring comprises carbon fibre and thermosetting plastic;

the fibre-reinforced polymer composite material of the inner ring comprises aramid fibre and thermosetting plastic;

the fibre-reinforced polymer composite material of the inner ring comprises glass fibre and thermosetting plastic;

the thermosetting plastic comprises an epoxy plastic;

the material in the outer ring comprises a polyurethane elastomer;

the contact surface between the outer ring of the rotating band and the inner ring is wedge-shaped. As a result of a wedge-shaped contact surface between the outer ring and the inner ring, the outer ring, during set-up and at launch, will be pressed against the wedge-shaped contact surface of the inner ring. Better connection and adhesion between the outer ring and the inner ring, and better gas sealing against the barrel compared with if the contact surface between the inner ring and the outer ring is designed flat, are thus achieved;

the contact surface between the outer ring of the rotating band and the inner ring is sawtooth-shaped. By increasing the contact surface between the outer ring and the inner ring with a sawtooth shape on the contact surface, a better connection between the outer ring and the inner ring is given;

the outer radius of the outer ring is angled for wedge-shaped fitting against the rifling of the barrel;

the length of the chamfer made on the outer ring constitutes 10%-80% of the total width of the rotating band;

the depth of the chamfer made on the outer ring constitutes 10%-80% of the thickness of the outer ring;

the thickness of the outer ring constitutes 50%-150% of the thickness of the inner ring;

lubricant is applied to that surface of the inner ring which is facing towards the projectile and/or to that surface of the projectile which is facing towards the inner ring.

In addition, the invention is constituted by a slipping rotating band intended to be slippably fitted on a projectile, which rotating band comprises an inner concentric ring and an outer concentric ring, in which the outer ring, which seals against the barrel, is affixed to the inner ring, and in which the inner ring is made of fibre-reinforced polymer composite or particle-reinforced polymer composite, or fibre-reinforced metal matrix composite or particle-reinforced metal matrix composite.

The invention is further constituted by a method for producing a slipping rotating band comprising an inner concentric ring and an outer concentric ring, in which the inner ring is made of fibre-reinforced polymer composite or particle-reinforced polymer composite, or fibre-reinforced metal matrix composite or particle-reinforced metal matrix composite, and in which the outer ring is made of elastic material, and the outer ring is affixed to the inner ring by vulcanization.

ADVANTAGES AND EFFECTS OF THE INVENTION

In the currently existing solutions for slipping rotating bands, a rotating band made of plastics material is used, which plastics rotating band detaches from the projectile, wholly or in parts, following launch from the barrel. Once the rotating band has been accelerated to the same speed as the projectile, then the rotating band or parts of the rotating band will, per se, become one or more projectiles and give rise to an increased risk for persons and equipment in the vicinity of the launcher. By eliminating the prospect of the rotating band leaving the projectile, the risk of unwanted injuries or damage is reduced.

LIST OF FIGURES

The invention will be described in greater detail below with reference to the appended figures, in which.

DETAILED DESCRIPTION OF EMBODIMENTS

Figure 1:
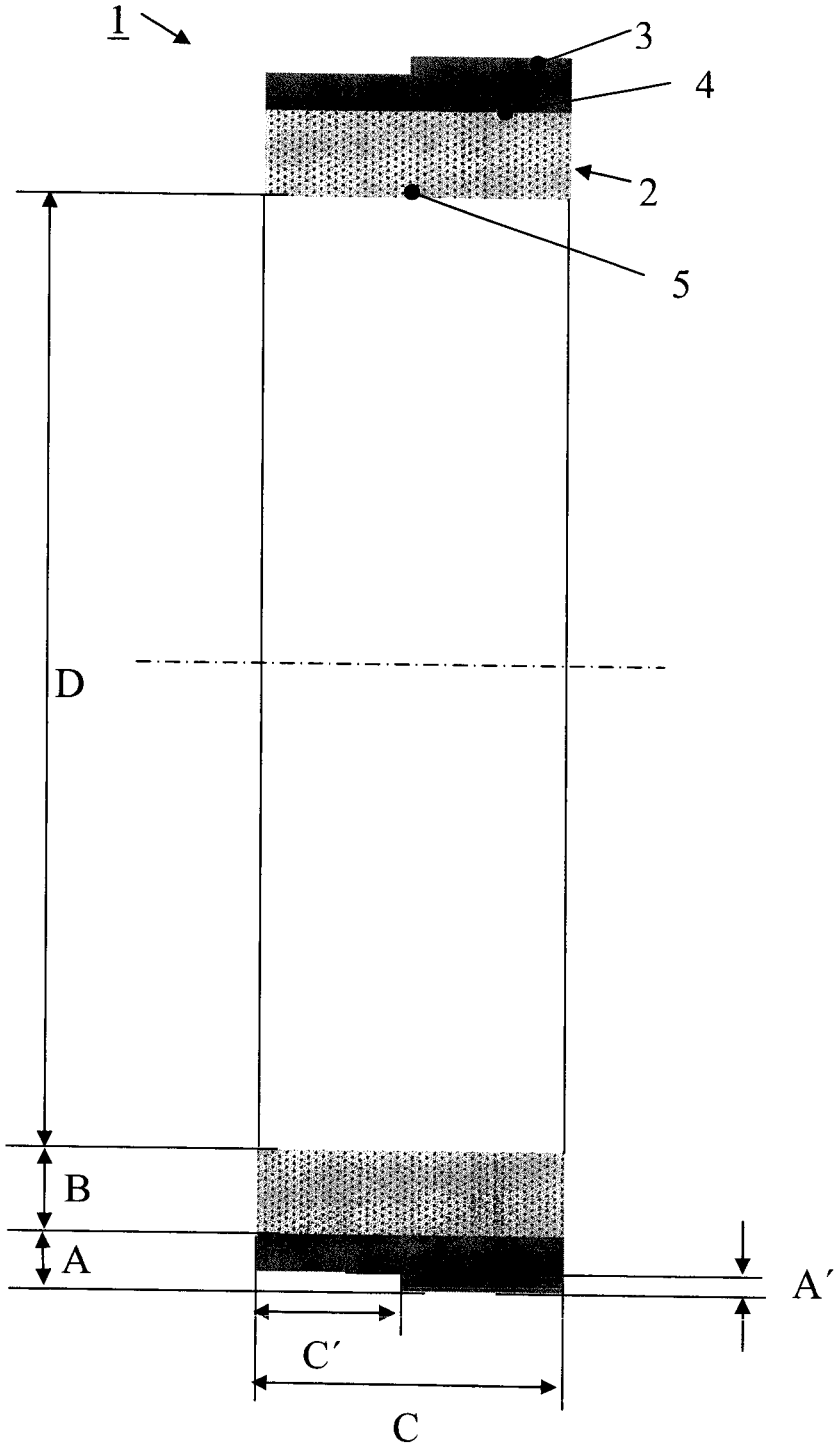
FIG. 1 shows a rotating band in cross section according to the invention.

In FIG. 1 is shown that embodiment of the rotating band 1 which consists of an inner ring 2, with thickness B, and an outer ring 3, with thickness A, in which the inner ring 2 is made of a load-bearing and dimensionally strong material which is dimensionally stable along the path of the projectile. The material in the inner ring 2 is chosen to give low friction when the ring 2 rotates against the projectile body, even though it is conceivable that the surface 5 between the inner ring 2 and the projectile body can be surface-treated to create low friction or otherwise reduce the friction. In order to achieve sufficiently good load-bearing capacity both during launch and along the path of the projectile from launcher to target, the inner ring 2 must be reinforced with fibres or particles, for example carbon fibres, aramid fibres or glass fibre. The surface 5 between the inner ring 2 and the projectile body is configured such that rotation of the rotating band relative to the projectile body is facilitated. It can also mean that the inner diameter D of the inner ring 2 is somewhat larger than the mounting position on the outer diameter of the projectile. The outer ring 3 can be affixed to the inner ring 2 by chemical, thermal or mechanical bonding, but other bonding methods can also be found. Examples of chemical bonding are vulcanization or gluing. An example of thermal bonding is to dimension the outer diameter of the ring 2 somewhat larger than the inner diameter of the ring 3 and to mount the ring 3 in the heated, and thus expanded, state. An example of mechanical bonding is to provide the inner ring 2 with pins or mesh against which the outer, softer ring 3 is mounted and is thus bonded to the inner ring 2.

The outer ring 3 is elastic and is configured to effectively grip against the rifling in the barrel in the setting up of the projectile. For example, an angling (not shown in the figure) or chamfer can be effected in the front edge of the rotating band. The length C' of the chamfer is a part of the total width C of the rotating band. The projectile shall be held in the set-up position by the deformation of the rotating band by the rifling. The rotating band has a chamfer with the depth A', which constitutes a part of the total thickness A of the outer ring 3. The material choice in the outer ring 3 is thus important in order that the deformation against the rifling shall be such that the projectile is held. If the outer ring 3 is too hard, the deformation against the rifling can be incomplete and thus the projectile is not held in the set-up position. In the same way, if the outer ring 3 is too soft, then the deformed outer ring 3 will not be able to hold the projectile in the set-up position. In addition, the outer ring 3 gas-seals against the barrel in order to preclude the gases which are generated by the propelling charge from leaking past the projectile at launch. Essentially the greater part of the gas pressure shall be created and maintained behind the projectile. The chosen material in the outer ring 3 must therefore seal against the gas created by the propelling charge and be able to handle both the pressure increase and the temperature increase which occur. Examples of materials which can be used in the outer ring 3 are polyurethane or another elastomer.

Figure 2:
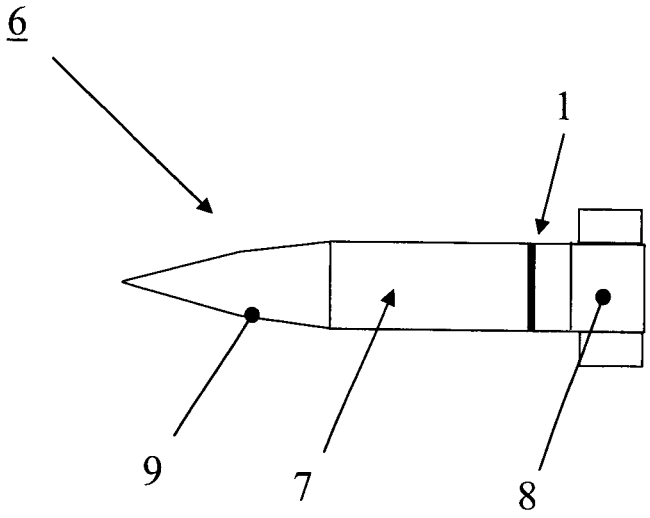
FIG. 2 shows a projectile for artillery according to the invention, with rotating band according to the invention.

In FIG. 2 is shown a projectile 6 for artillery provided with a rotating band 1. The projectile consists of a projectile body 7 and a base 8 which is freely rotatable from the projectile body or is fixedly mounted. The slipping and permanent rotating band 1 is mounted on the projectile. In the front part of the projectile body 7 are found fins 9, also referred to as canard fins, which are deployed for guidance of the projectile 6 along the path of the projectile.

Figure 3:
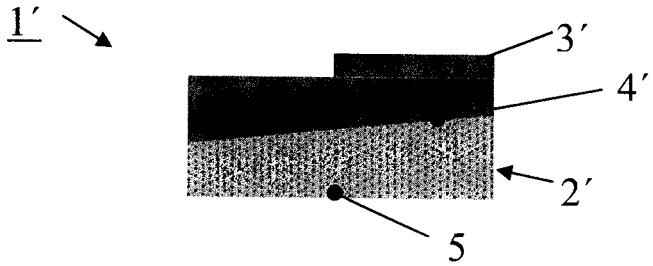
FIG. 3 shows an alternative embodiment of the rotating band according to the invention.

In FIG. 3 is shown an alternative embodiment of the rotating band, in which the surface 4' between the inner ring 2' and the outer ring 3' is conical.

Figure 4:
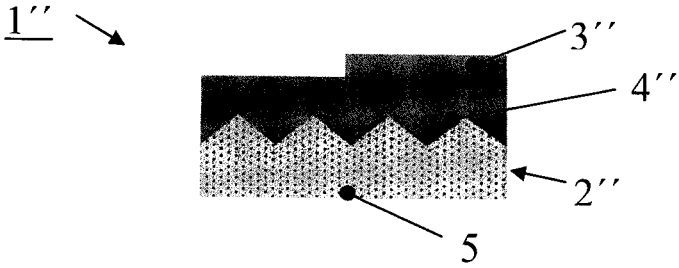
FIG. 4 shows another alternative embodiment of the rotating band according to the invention.

In FIG. 4 is shown an alternative embodiment of the rotating band, in which the surface 4" between the inner ring 2" and the outer ring 3" is sawtooth-shaped in order to enable better joining together between the outer ring 3" and the inner ring 2".

Functional Description

The functioning and use of a slipping permanent rotating band 1 according to the invention is as follows. In the case of artillery ammunition, the projectile 6 and the propelling charge are normally separate units and the launcher, often referred to as a gun or cannon, is therefore first loaded with the projectile 6, which is placed, also referred to as set up, in the barrel, after which the propelling charge is placed behind the projectile 6. In the setting up of the projectile 6, the projectile is propelled into the barrel such that the rotating band 1 is partially deformed by and coupled to the rifling in the barrel. The projectile 6 is held in the barrel by deformation of the rotating band 1 against the rifling in the barrel. Behind the projectile 6 is placed propellant, which is matched to the firing conditions. After this, the chamber is closed off with preferably a screw or cotter pin. At ignition, an ignition cartridge or other igniter which ignites the propellant is used. When the propellant burns, gas is generated, which gas, depending on the gas pressure, forces the projectile 6 through the barrel. The gas pressure which arises upon ignition of the propellant behind the projectile 6 depends partly on the chemical and physical character of the propellant, but also on the weight of the projectile 6, as well as the friction which is formed between the rotating band 1 of the projectile 6 and the rifling of the barrel. For the rotational stabilization of projectiles, the rifling has a pitch in the barrel in order to rotate the rotating band 1, and thus the projectile 6, in the barrel and thereby rotate and rotationally stabilize the projectile 6 along its path after the projectile 6 has left the barrel. In certain cases, smooth-bore barrels are used when no rotation of the projectile 6 is desirable, in which case stabilization of the projectile 6 along the path is often effected by the aerodynamic configuration of the projectile, for example with deployable or fixedly mounted fins.

Where no rotation of the projectile 6 is desired but the barrel is constructed with rifling, a slipping rotating band 1 is used on the projectile 6. If the rotating band 1 is slipping, then the rotating band 1 will slip against the projectile body 7 when the projectile 6 is fired from the barrel and the rotating band 1 is rotated by the rifling in the barrel. The projectile 6 will generally be partially rotated, since certain frictional coupling between the rotating band 1 and the projectile 6 cannot be avoided. That inner surface 5 of the rotating band 1 which bears against the projectile 6 is freely rotatable relative to the projectile body 7. Both the material choice and the production method of the rotating band 1 are realized such that the friction between the rotating band 1 and the projectile body 7 is very small. An example of a production method is to make the inner diameter D of the rotating band 1 be somewhat larger than the outer diameter of the projectile body 7 in the position in which the rotating band 1 is mounted. Examples of a choice of material are both thermosetting plastics and thermoplastics. The surface 5 of the inner ring 2 between the rotating band 1 and the projectile body 7 can also be surface-treated with a grease or an oil or another substance in order to reduce the friction. The rotating band 1 is divided into an inner ring 2 and an outer ring 3, in which the inner ring 2 is load-bearing and holds together the ring, and thus the rotating band 1, throughout the launch process in the barrel and along the path of the projectile 6 from launch to target. The inner load-bearing ring 2 is configured with good strength in order to handle the forces which arise on the inner ring 2. Especially when the projectile 6 leaves the barrel, gunpowder gases under the inner ring 2 will exert a pressure upon the inner ring 2 before the gases are ventilated from the interspace between the projectile body 7 and the surface 5 on the inner radius of the inner ring 2. Along the path of the projectile 6 from launch to target, centrifugal forces come to act upon the rotating band 1. The outer ring 3 is designed to be deformed by the rifling in the barrel and is thus made of a soft material such as, for example, polyurethane or another elastomer. The construction of the rotating band 1 is such that the thickness A of the outer ring 3 is in the order of magnitude of 50%-150% of the thickness B of the inner ring 2.

The chamfer C' of the width C of the rotating band 1 is in the order of magnitude of 10%-80% of the width C of the rotating band. The depth A' of the chamfer made in the outer ring 3 is in the order of magnitude of 10%-80% of the total thickness A of the outer ring 3.

In that embodiment of the rotating band 1' which is shown in FIG. 3, the surface 4' between the inner ring 2' and the outer ring 3' is conical. When the projectile is first set up and is subsequently fired and moves in the barrel, the outer ring 3' will be pushed against the wedge-shaped surface 4', which results in good sealing between the barrel and the rotating band 1'.

In that embodiment of the rotating band 1" which is shown in FIG. 4, the surface 4" between the inner ring 2" and the outer ring 3" is saw-toothed in order to give good adhesion between the outer ring 3" and the inner ring 2".

Other embodiments of the surface 4 between the inner ring 2 and the outer ring 3 which strengthen adhesion between the inner ring 2 and the outer ring 3 and bond together the inner ring 2 and the outer ring 3 during the launch process can be, for example, different forms of knurling, grooving some or other method for improving the adhesion between the rings.

An alternative embodiment of the projectile can be in the form of a cartridged ammunition shot when the projectile is mounted in a sleeve enclosing a propellant, preferably in the form of a gunpowder. The ammunition shot preferably also comprises an igniter for initiation of a propellant, often in the form of electrical ignition or mechanical ignition by impact.

Illustrative Embodiment

An example of a projectile with permanent slipping rotating band is a 155 mm artillery shell, in which stabilization along the path of the shell is effected by fin deployment which is commenced after the shell leaves the barrel. The permanent slipping rotating band is made of an inner ring of carbon-fibre-reinforced epoxy, to which a polyurethane ring has been joined by vulcanization.

Alternative Embodiments

The invention is not limited to the embodiments specifically shown, but can be varied in different ways within the scope of the patent claims.

It will be appreciated, for example, that the number, size, material and shape of the elements and parts which make up the permanent slipping rotating band are adapted to the weapon system(s) and other design features which are relevant at that time.

It will be appreciated that the above-described projectile embodiments having a permanent slipping rotating band can comprise many different dimensions and projectile types, depending on the field of application and the barrel width. In the above, however, reference is made to at least the currently most common shell types of between about 25 mm and 200 mm.

The invention claimed is:

1. A projectile which comprises a slipping rotating band designed for firing from a weapon system with a rifled barrel, which rotating band comprises an inner concentric ring and an outer concentric ring that seals against the barrel, which outer ring is fitted on the outer surface of the inner ring and which inner ring is slippably fitted on the projectile, the outer ring, which seals against the barrel, is affixed to the inner ring, and the inner ring slippably fitted on the projectile is made of fibre-reinforced polymer composite or particle-reinforced polymer composite, or fibre-reinforced metal matrix composite or particle-reinforced metal matrix composite, wherein the rotating band is configured to remain fitted on the projectile throughout the launch process of the projectile and in the path of the projectile from launcher to target.

2. The projectile according to claim 1, wherein the fibre-reinforced polymer composite material of the inner ring comprises carbon fibre and thermosetting plastic.

3. The projectile according to claim 2, wherein the thermosetting plastic comprises an epoxy plastic.

4. The projectile according claim 2, wherein the material in the outer ring comprises a polyurethane elastomer.

5. The projectile according to claim 1, wherein the fibre-reinforced polymer composite material of the inner ring comprises aramid fibre and thermosetting plastic.

6. The projectile according to claim 5, wherein the thermosetting plastic comprises an epoxy plastic.

7. The projectile according claim 5, wherein the material in the outer ring comprises a polyurethane elastomer.

8. The projectile according to claim 1, wherein the fibre-reinforced polymer composite material of the inner ring comprises glass fibre and thermosetting plastic.

9. The projectile according to claim 8, wherein the thermosetting plastic comprises an epoxy plastic.

10. The projectile according claim 8, wherein the material in the outer ring comprises a polyurethane elastomer.

11. The projectile according to claim 1, wherein the material in the outer ring comprises a polyurethane elastomer.

12. The projectile according to claim 1, wherein the contact surface between the outer ring of the rotating band and the inner ring is wedge-shaped.

13. The projectile according to claim 1, wherein the contact surface between the outer ring of the rotating band and the inner ring is sawtooth-shaped.

14. The projectile according to claim 1, wherein the outer radius of the outer ring is angled for wedge-shaped fitting against the rifling of the barrel.

15. The projectile according to that claim 1, wherein the outer ring comprises a chamfer having a length (C') that constitutes 10%-80% of the total width (C) of the rotating band.

16. The projectile according to claim 1, wherein the outer ring comprises a chamfer having a depth (A') that constitutes 10%-80% of the thickness (A) of the outer ring.

17. The projectile according to claim 1, wherein the outer ring comprises a chamfer having a thickness (A) that constitutes 50%-150% of a thickness (B) of the inner ring.

18. The projectile according to claim 1, wherein lubricant is applied to that surface of the inner ring which is facing towards the projectile and/or to that surface of the projectile which is facing towards the inner ring.

19. A slipping rotating band intended to be slippably fitted on a projectile, which rotating band comprises an inner concentric ring and an outer concentric ring, wherein the outer ring, which seals against a barrel of a weapon system, is affixed to the inner ring, and wherein the inner ring is made of fibre-reinforced polymer composite or particle-reinforced polymer composite, or fibre-reinforced metal matrix composite or particle-reinforced metal matrix composite.

20. A method for producing a slipping rotating band comprising an inner concentric ring and an outer concentric ring, which comprises obtaining an inner ring made of fibre-reinforced polymer composite or particle-reinforced polymer composite, or fibre-reinforced metal matrix composite or particle-reinforced metal matrix composite, obtaining an outer ring made of elastic material, and affixing the outer ring to the inner ring by vulcanization.

* * * * *